US006520707B1

(12) United States Patent
Headrick

(10) Patent No.: US 6,520,707 B1
(45) Date of Patent: Feb. 18, 2003

(54) CAN CLIP DEVICE WITH TOY CONSTRUCTION SET ENGAGEMENT ELEMENTS

(76) Inventor: Joseph R. Headrick, 355 N. Lantana, #334, Camarillo, CA (US) 93010

( * ) Notice: Subject to any disclaimer, the term of this patent is extended or adjusted under 35 U.S.C. 154(b) by 0 days.

(21) Appl. No.: 09/577,710

(22) Filed: May 23, 2000

Related U.S. Application Data

(63) Continuation-in-part of application No. 09/264,496, filed on Mar. 8, 1999.

(51) Int. Cl.[7] ..... B65D 71/00

(52) U.S. Cl. ..... 403/282; 403/329; 220/440; 206/151

(58) Field of Search ..... 403/282, 329; 220/440; 206/151

(56) References Cited

U.S. PATENT DOCUMENTS

| | | | | | |
|---|---|---|---|---|---|
| 4,985,980 | A | * | 1/1991 | Gould | 29/525.1 |
| 5,505,330 | A | * | 4/1996 | Numes | 220/742 |
| 5,590,974 | A | * | 1/1997 | Yang | 403/329 X |
| 5,653,550 | A | * | 8/1997 | Mutz et al. | 403/329 |
| 5,848,855 | A | * | 12/1998 | Roossien | 403/329 |

* cited by examiner

*Primary Examiner*—Lynne H. Browne
*Assistant Examiner*—John R. Cottingham
(74) *Attorney, Agent, or Firm*—Gene W. Arant

(57) ABSTRACT

A drink can holder is made as an integrally formed body of resilient plastic material with a central body portion and a number of radially extending finger assemblies circumferentially spaced around it. Each finger assembly has integrally formed protrusions and recesses that may, when a plurality of such drink can holders are used, be interengaged to provide toy construction set elements.

7 Claims, 4 Drawing Sheets

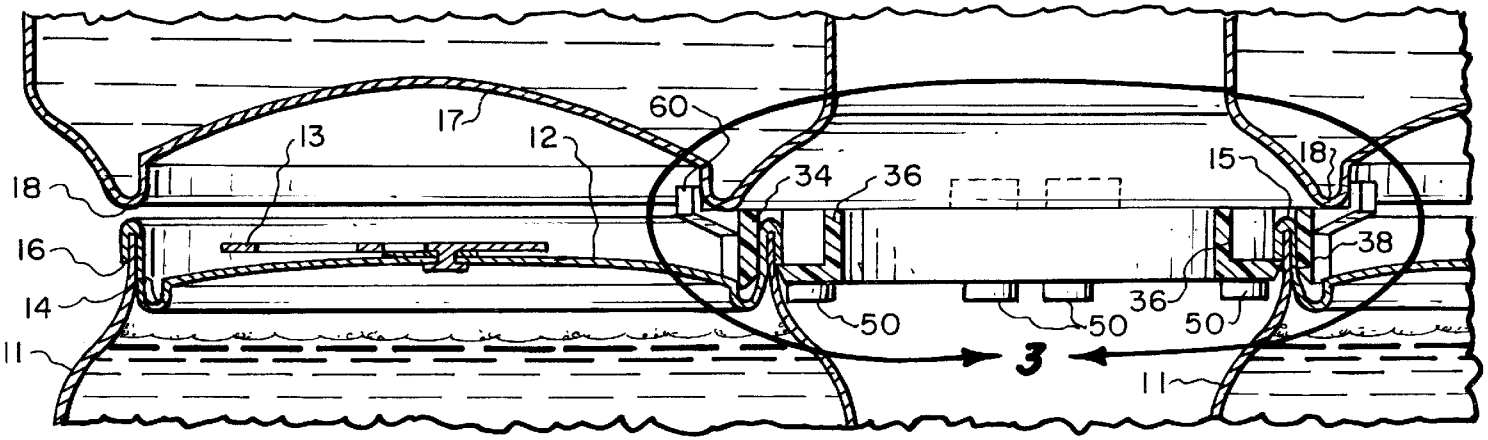
Fig. 2.
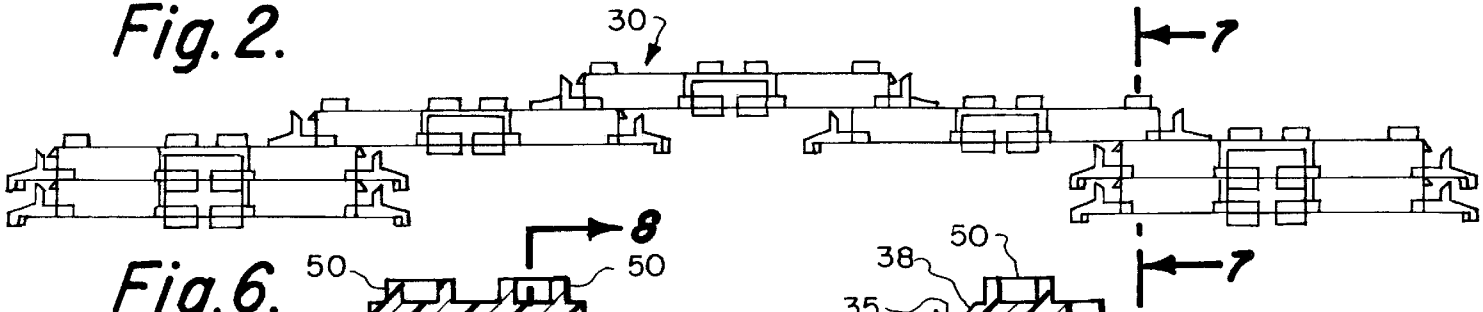
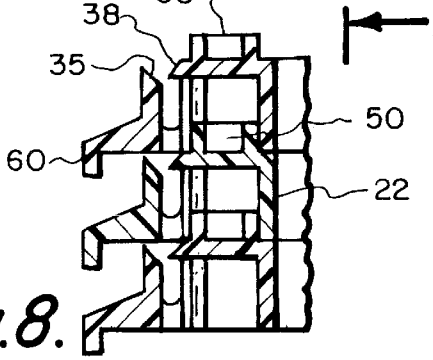
Fig. 8.
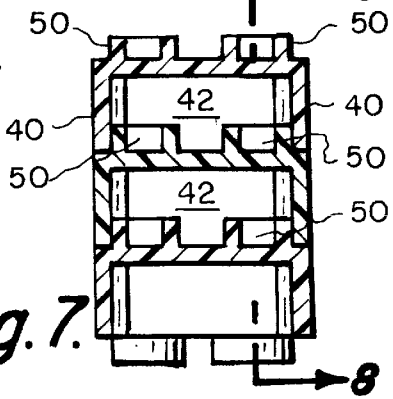
Fig. 6.
Fig. 7.

CAN CLIP DEVICE WITH TOY CONSTRUCTION SET ENGAGEMENT ELEMENTS

RELATED APPLICATIONS

This application is a continuation-in-part of my application Ser. No. 09/264,496 filed Mar. 8, 1999, which in turn claimed the priority of my design application Ser. No. 85,787 filed Mar. 30, 1998, now Design U.S. Pat. No. 406,526 which was issued Mar. 9, 1999 and entitled "DETACHABLE HOLDER FOR FOUR DRINK CANS".

FIELD OF THE INVENTION

This invention relates to a support or holding device which is also re-usable as an element of a toy set.

SUMMARY OF THE INVENTION

According to the present invention a drink can holder for releasably supporting drink cans from their tops is made as an integrally formed body of resilient plastic material having a central body portion with a number of finger assemblies that are circumferentially spaced around it and extend radially outward from it. Each finger assembly is adapted to releasably grasp the top of a drink can. Each finger assembly also has toy construction set engagement elements formed integral with it, those engagement elements consisting of interengaging protrusions and recesses.

DRAWING SUMMARY

FIG. 2 is a vertically cross-sectional view taken on the line 2—2 of FIG. 1, showing two drink cans supported beneath my novel holder, and additionally showing another pair of drink cans resting upon the top of my attachment device;

FIG. 6 is a side elevation view, again somewhat schematic in form, showing how a number of drink can holders in accordance with the invention may be utilized to make a toy structure;

FIG. 7 is a cross-sectional elevation view taken on the line 7—7 of FIG. 6;

FIG. 8 is a cross-sectional elevation view taken on the line 8—8 of FIG. 7;

DETAILED DESCRIPTION OF PREFERRED EMBODIMENT

(FIGS. 1–8)

Figure 1:
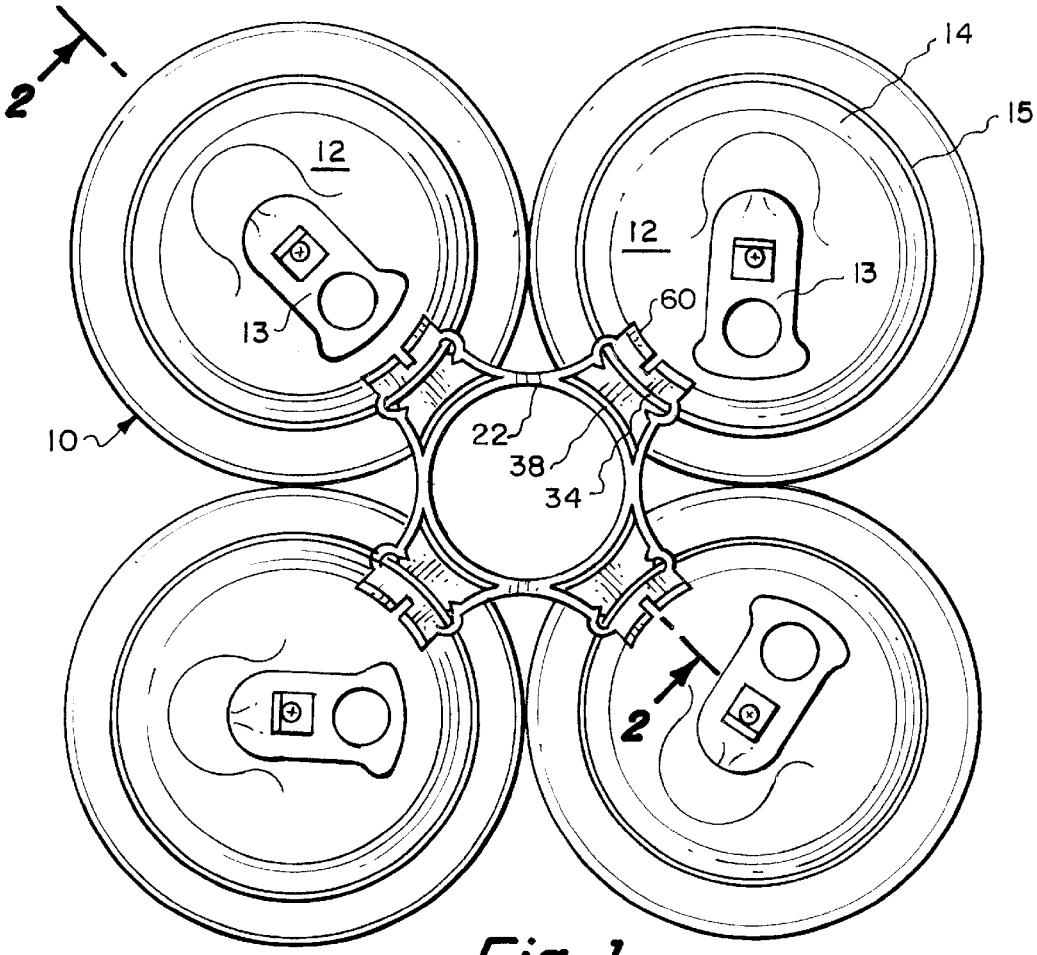
FIG. 1 is a top plan view of four drink cans to which a drink can holder in accordance with my invention has been attached.
Figure 4:
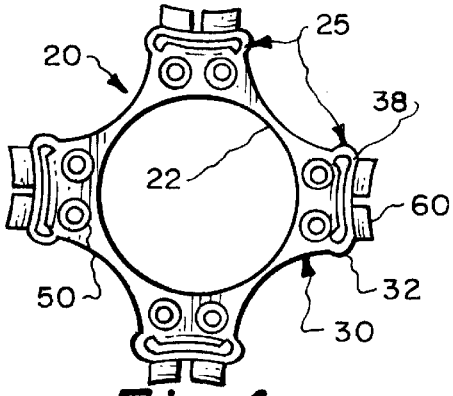
FIG. 4 is a bottom view of a holder in accordance with the invention.
Figure 5:
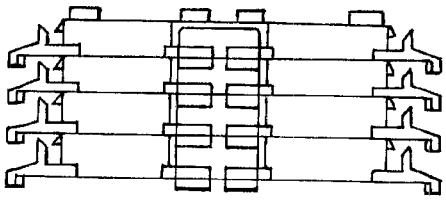
FIG. 5 is a side elevation view, somewhat schematic in form, showing how a number of drink can holders in accordance with the invention can be put together in a vertical stack.

It will be helpful to describe a typical drink can, even though the drink can, as such, forms no part of the present invention.

A typical drink can 10 has a generally cylindrical side wall 11 and a top wall 12 that is generally flat. In its mid-portion the top wall 12 has a conventional flip-top portion 13. At its outer circumferential portion the top wall 12 forms an annular trough 14. The further extending radial portion of top wall 12 then extends upward, over, and around the topmost edge of side wall 11 to form a chime 15. At the bottom of chime 15, on the outside of the can 10, the top wall 11 has a lower edge 16. At its bottom end the can 10 has a generally flat bottom end wall 17, on which a circular ridge 18 is formed.

Thus, in general, it will be seen that a typical can is formed with a generally cylindrical side wall, and has a generally flat top end wall with a circumferential edge portion forming an annular trough beyond which the top wall is then bent upward and over and around the upper edge of the side wall to form a chime. The outer edge of the top wall then extends partly down the outer surface of the side wall. The typical can also has a conventional flip-top mechanism on top. The bottom end of the can has a generally flat wall but with a circumferential ridge formed thereon, spaced inward from the outer wall surface.

The drink can holder or can clip device 20 of the present invention is preferably integrally formed of a plastic material, and has a generally cylindrical central body 22. A plurality of securing means 25 are provided to firmly but releasably attach the clip to the chimes of cans. Each securing means includes a finger assembly 30 having an outer edge portion 32 adapted to extend over and around the chime 15 of a can and forming a downwardly extending lip 33 whose inner wall surface 34 is convexly shaped in the horizontal plane for engaging the inner wall surface of the chime. The inner wall surface 34 is also tapered at 35 to permit easier engagement with the chime of the can.

Each finger assembly 30 also has an inner edge portion 36 with a surface 37 that is concave in the horizontal plane for engaging the outer circumferential surface of the side wall 11 of can 10 just below the lower edge 16 of the chime 15. The concave surface 37 also has a blade-like edge 38 for best engagement with the can.

A very important feature of the invention is that the finger assembly is sufficiently flexible so that, when it engages a can, the chime of the can is frictionally held between the lip of the finger assembly and its concave inner edge surface to thereby enable the drink can holder to vertically support the weight of the can and its contents. In certain situations the drink can holder may also be used to provide other kinds of support as well.

The outer edge portion 32 of finger assembly 30 has parallel side walls 40 between which an upwardly facing recess 42 is formed. On the lower or bottom surface of portion 32 of the finger assembly are a pair of cylindrical protrusions 50. The pair of protrusions 50 are so configured and positioned as to frictionally engage the recess 42 of another similar drink can holder (see FIG. 7). The pair of protrusions 50 formed on the under surface of the inner edge portion 32 of finger assembly 30 are adapted to be releasably retained within an identical such recess 42 when two or more of such can holder members are used as structural elements to make take-apart toy structures.

Figure 3:
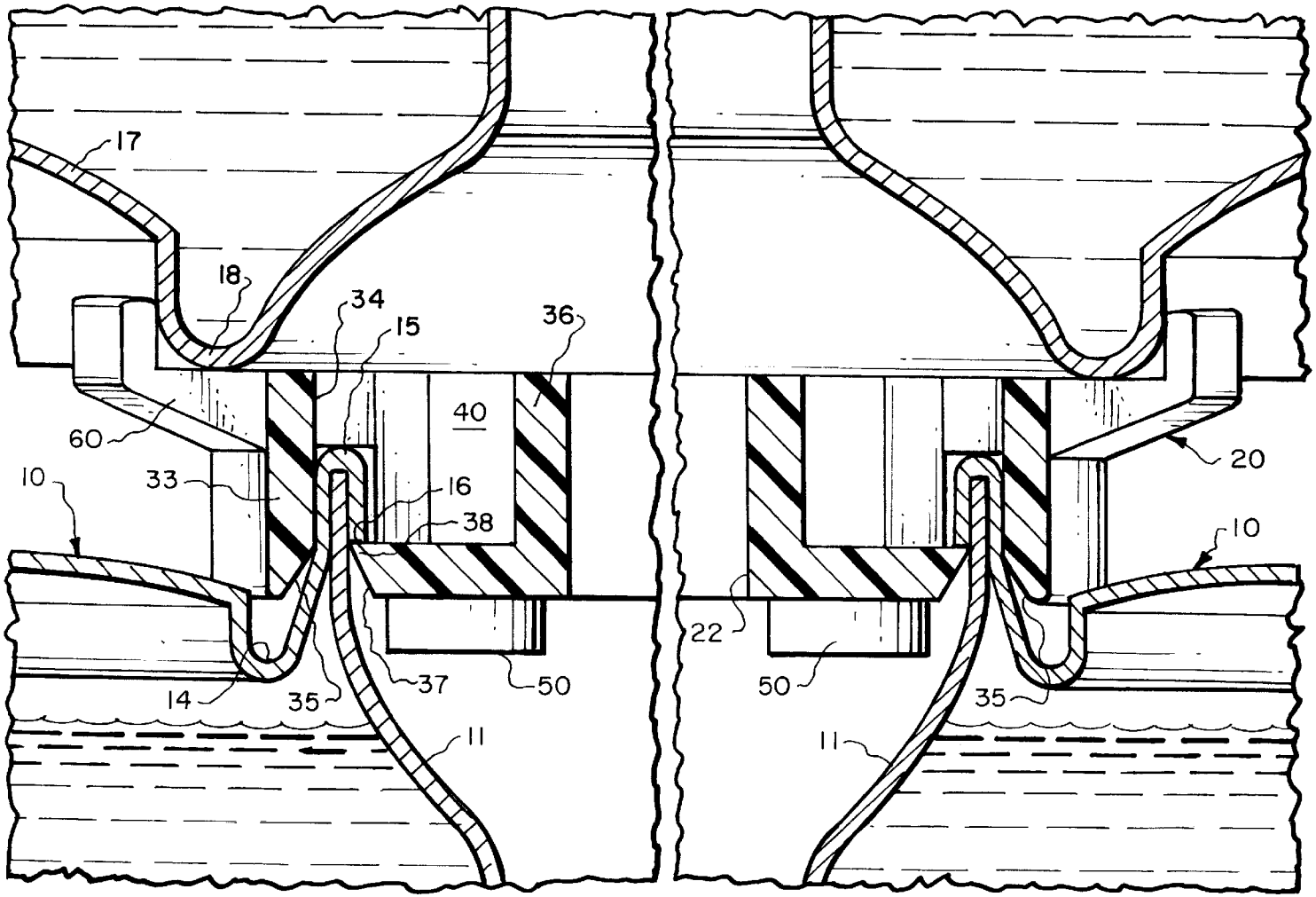
FIG. 3 is an enlarged fragmentary view taken in the circled area 3—3 of FIG. 2.

Another part of each securing means 25, and extending from the protruding outer edge portion of each finger assembly 30, there is an upwardly extending tab 60 adapted to engage and support the bottom end surface of another drink can that may be superimposed thereon. See FIG. 3, where its engagement with the bottom end ridge 18 is shown.

ALTERNATE FORM

Figure 9:
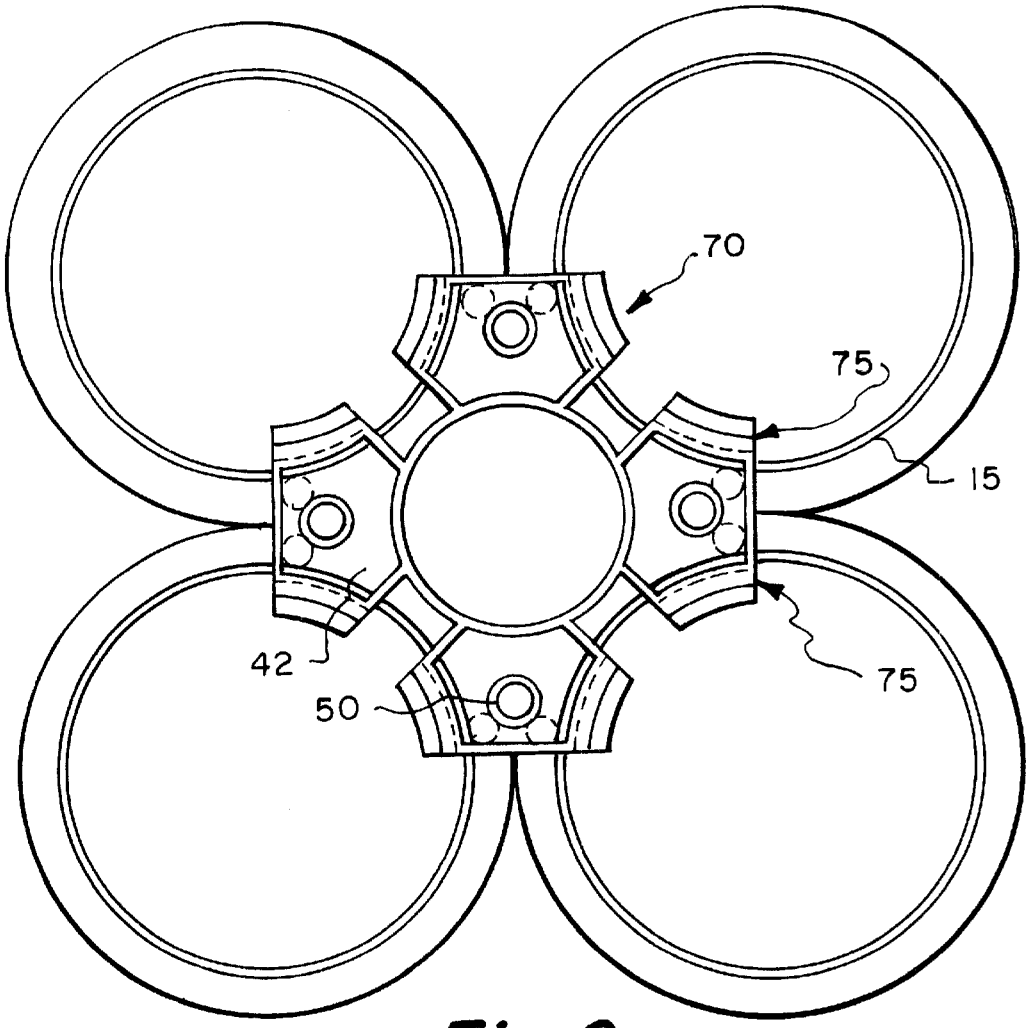
FIG. 9 is a plan view of an alternate form of drink can holder in accordance with the invention.
Figure 10:
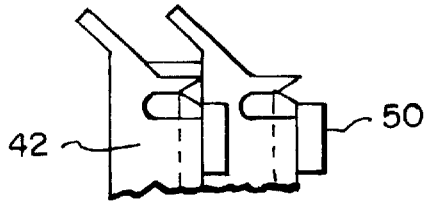
FIG. 10 is a fragmentary cross-sectional view showing how one drink can holder in accordance with FIG. 9 may be stacked onto another similar one.

FIGS. 9 and 10 show an alternate form 70 of my invention in which each finger assembly has two diverging parts 75. Each part of one finger assembly engages the chime of a different can, and each can as shown in FIG. 9 is supported by two different finger assemblies. This form of the invention is advantageous for the purpose of achieving a stronger and more rugged support of the set of drink cans that are held by the holder.

While the drawings show recess 42 facing upwardly and the protrusions 50 facing downwardly, it will be understood that in accordance with my invention the shape of the holder may be modified somewhat so that the opposite is true; that is, the recesses may face down and the protrusions extend up.

While many modifications will be apparent to those skilled in the art, the invention has been fully disclosed in its presently preferred form to fully comply with the requirements of the patent laws, and it should therefore be understood that the scope of the invention is to be judged only in accordance with the appended claims.

PARTS LIST

10 drink can
11 side wall
12 top wall
13 flip top
14 trough
15 chime (up & over)
16 lower edge of top wall at outside of can
17 bottom end wall
18 ridge on bottom end
20 can clip device=drink can holder
22 cyl. central body
25 securing means (plurality of)
30 finger assembly
32 outer edge portion
33 lip
34 convex inner wall surface
35 taper on inner wall surface
36 inner edge portion
37 concave surface
38 blade edge
40 parallel walls of part 32 of finger assy 30
42 recess between parallel walls
50 protrusions
60 tab (for bottoms)
70 alternate form
75 diverging finger assemblies

I claim:

1. In the art of releasably supporting drink cans from their tops, wherein each can is formed with a generally cylindrical side wall and has a generally flat top end wall with a circumferential edge portion forming an annular trough beyond which the top wall is then bent upward and over and around the upper edge of the side wall to form a chime; a drink can holder, comprising:

an integrally formed plastic member having a generally cylindrical main body with an upper end and a lower end, and a plurality of identical finger assemblies that extend radially outwardly therefrom in a horizontal plane at spaced circumferential positions thereon;

each finger assembly having an outer edge portion adapted to extend over and around the chime of a can and forming a downwardly extending lip whose inner wall surface is convexly shaped in the horizontal plane for engaging the inner wall surface of the chime;

each finger assembly also having an inner edge portion with a concave surface in the horizontal plane for engaging the outer circumferential surface of the can beneath the chime;

the finger assembly being flexible so that, when it engages a can, the chime of the can is frictionally held between the lip of the finger assembly and its concave inner edge surface to thereby enable the drink can holder to vertically support the weight of the can and its contents; and each finger assembly in its extending outer edge portion also having a recess formed therein, and a pair of protrusions formed thereon which may be releasably retained within an identical such recess when two or more of such can holder members are used as structural elements to make take-apart toy structures.

2. A drink can holder as in claim 1 wherein the outer edge portion of each finger assembly has a pair of generally parallel walls that form a recess therebetween, the inner edge portion being integral with the bottoms of those walls; and each finger assembly also has a pair of protrusions formed on the under surface of the inner edge portion and adapted to be releasably retained within an identical such recess when two or more of such can holder members are used as structural elements to make take-apart toy structures.

3. A drink can holder as in claim 1 wherein the protrusions are cylindrical in shape.

4. A drink can holder as in claim 1 wherein the concave surface of the inner edge portion of each finger assembly in the horizontal plane forms a blade-like edge for engaging the outer circumferential surface of the can beneath the chime.

5. A drink can holder as in claim 1 wherein the protruding outer edge portion of each finger assembly further includes an upwardly extending tab adapted to engage and support the bottom end surface of another drink can that may be superimposed thereon.

6. A drink can holder made as an integrally formed body of resilient plastic material having a central body portion with a number of finger assemblies circumferentially spaced around it and extending radially outward from it, each finger assembly being adapted to releasably grasp the top of a drink can, and each finger assembly also having integrally formed protrusions and recesses adapted for interengagement when a plurality of such drink can holders are used to provide toy construction set elements;

each finger assembly having an outer edge portion adapted to extend over and around a chime of a can for engaging the inner wall surface of the chime, and an inner edge portion for engaging the outer circumferential surface of the can beneath the chime;

said outer edge having a pair of generally parallel walls that form a recess therebetween, the inner edge portion being integral with the bottoms of those walls; and each finger assembly also having a pair of protrusions formed on the under surface of the inner edge portion and adapted to be releasably retained within an identical such recess when two or more of such can holder members are used as structural elements to make take-apart toy structures.

7. A drink can holder as in claim 6 wherein the protrusions are cylindrical in shape.

* * * * *